US005564980A

United States Patent [19]

Becker

[11] Patent Number: 5,564,980

[45] Date of Patent: Oct. 15, 1996

[54] ROOM AIR QUALITY CONDITIONING SYSTEM

[76] Inventor: Sydney J. Becker, 220 Olivier Ave., Apt. 401, Westmount, Quebec, Canada, H3Z 2C5

[21] Appl. No.: 386,264

[22] Filed: Feb. 9, 1995

[51] Int. Cl.[6] ..... F24F 7/007

[52] U.S. Cl. ..... 454/252; 454/292

[58] Field of Search ..... 454/251, 252, 454/292, 338

[56] References Cited

U.S. PATENT DOCUMENTS

| | | | |
|---|---|---|---|
| 1,296,968 | 3/1919 | Klein . | |
| 1,925,822 | 9/1933 | Shurtleff . | |
| 2,126,230 | 8/1938 | Troxell, Jr. . | |
| 2,148,254 | 2/1939 | Bergstrom . | |
| 2,184,484 | 12/1939 | Bojner . | |
| 2,231,797 | 2/1941 | Carson . | |
| 2,267,425 | 12/1941 | Rowe et al. . | |
| 2,275,295 | 3/1942 | Greenway . | |
| 2,354,292 | 7/1944 | Waterman . | |
| 2,398,627 | 4/1946 | Disbro et al. . | |
| 2,457,934 | 1/1949 | Spieth | 454/338 X |
| 2,727,365 | 12/1955 | Rosell . | |
| 3,669,349 | 6/1972 | Hall, Jr. . | |
| 3,974,754 | 8/1976 | Powlesland et al. . | |
| 4,055,112 | 10/1977 | Larkfeldt . | |
| 4,519,217 | 5/1985 | Phillips et al. . | |
| 4,535,684 | 8/1985 | Perng . | |
| 4,554,766 | 11/1985 | Ziemer et al. . | |
| 4,598,632 | 7/1986 | Johnson, III | 454/292 |
| 5,097,674 | 3/1992 | Imaiida et al. | 454/292 X |
| 5,326,314 | 7/1994 | Brockway et al. | 454/252 X |

FOREIGN PATENT DOCUMENTS

| | | |
|---|---|---|
| 832788 | 1/1970 | Canada . |
| 942573 | 2/1974 | Canada . |
| 1057562 | 7/1979 | Canada . |
| 1090190 | 11/1980 | Canada . |
| 1134666 | 11/1982 | Canada . |

OTHER PUBLICATIONS

European Collaborative Action, Indoor Air Quality & Its Impact on Man, Environment and Quality of Life, Report No. 11, Guidelines for Ventilation Requirements in Buildings, 1992.

ANSI/ASHRAE 62–1989, including ANSI/ASHRAE Addendum 62a–1990, ASHRAE Standard, an American National Standard, Ventilation for Acceptable Indoor Air Quality.

CEN 156/WG 6 Doc N 92, Draft ENV XXX, 31 Jan., 1994, Ventilation for Buildings Design Criteria for the Indoor Enviornment.

*Primary Examiner*—Harold Joyce
*Attorney, Agent, or Firm*—Ezra Sutton

[57] ABSTRACT

An air circulation system includes an inflow system which includes a tube enclosure or cowl suspended from a ceiling of a room or from a roof above the room. The tube enclosure or cowl is fitted with a ceiling fan. An air supply unit external to the room (e.g., outdoors) includes an in flow fan connected to air supply duct and a variable air volume box having an inlet connected to the air supply duct and an outlet connected to the interior of the tube enclosure or cowl. The system also includes an outflow system which includes an exhaust grill which may be either suspended from the ceiling or be fitted to the wall of the room. An exhaust riser duct is connected to the exhaust grill. An exhaust fan is connected to the outlet from the exhaust riser. The exhaust fan is operated in conjunction with the inflow fan to exhaust, via the outflow system, substantially all the volume of air inflowing through the air inflow system into the inside room through the outflow system. In this way the quality of air in the inside room is improved by impelling a selected volume of outdoor air downwardly into inside room air, circulating the outdoor air within the inside room and expelling the selected volume of used inside room air from the inside room, and by allowing the occupant of the inside room to adjust comfort conditions by varying air circulation and the selected volume of outdoor air.

9 Claims, 2 Drawing Sheets

ROOM AIR QUALITY CONDITIONING SYSTEM

BACKGROUND OF THE INVENTION (a) Field of the Invention

This invention relates to a system for introducing outdoor air only to a room or space and achieve maximum mixing of the outdoor air with the room air without creating objectionable drafts or turbulence.

(b) Description of the Prior Art

The study of the subject of mechanical ventilation systems and indoor air quality has resulted in at least two publications: a European publication entitled "Ventilation For Buildings, Design Criteria For the Indoor Environment", (draft 31 Jan. 1994); and a U.S. publication entitled "ASHRAE Standard 62-1989, Ventilation For Acceptable Indoor Air Quality". Both these publications identify the requirement that the forced air circulation system should ventilate, but should not create turbulence or drafts that are uncomfortable for the occupants.

Forced air circulation systems are used in buildings occupied by humans. Such systems are used for three basic purposes, namely, heating, cooling and ventilating. Ventilation implies supplying outdoor air and removing pollution that is generated in the building by the occupants. The purpose of all this is to provide a comfortable and healthy environment. The effectiveness of a forced air circulation system in maintaining these conditions depends on how thoroughly the circulated air mixes with the space or room air, and the removal of the used air or contaminated air from the room or space.

Since people are sensitive to drafts and air temperature changes, present practice uses grills or diffusers to introduce the supply air to a space or room with the least turbulence and yet with sufficient movement and circulation to create the best mixing. The mixing is crucial, since it is the way the room or space is heated or cooled, and it is the way the contamination generated by the occupants is picked up and diluted so it can be exhausted from the room or space. However, in the use of grills or diffusers, a very small temperature difference is necessary.

Indoor air problems are a major health concern, and a public health problem that has enormous financial significance in all countries that have buildings that are mechanically ventilated by forced air circulation systems. This is due to the ineffective and inadequate performance of grills and diffusers in achieving thorough mixing of the introduced air and the room air.

The techniques presently in use to improve mixing in a space, are to increase the volume of air delivered to a room or space, i.e., the number of air changes per hour. However, to avoid increasing the energy requirements, present practice is to mix outdoor air or fresh air with recirculated air, i.e., used air, but with no means for positively expelling such mixed air outdoors. Nevertheless, it is known that such a process reduces the quality of the supply air by ignoring a basic public health law, namely, that outdoor air should not be mixed with used air, since used air is contaminated air. It is believed that this fact contributes to the cause of what is called the Sick Building Syndrome. Thus, present practice in the air conditioning industry ignores the fact that the respiratory system is also an avenue for infection.

One way to assist in the ventilation of a room in a building has been by the use of ceiling fans. Ceiling fans have been around for more than a century. The slow moving blades stir the air enough to make persons feel comfortable.

Patented systems have been provided in an attempt to assist in the ventilation of a room in a building. Thus, Canadian Patent No. 832,788 patented Jan. 27th, 1970 by A. Erfelling provided a ventilation apparatus with the arrangement of a ventilator adapted to be driven by motor, for the rooms of a building. The patented invention was alleged to have solved the problem of improving the flow and distribution of the air of a ventilation apparatus within the room of the building and to take care that when drawing-in fresh air it is practically ensured that the amount of fresh air drawn in is not contaminated by the outgoing used air. This was alleged to be achieved by ventilation apparatus comprising a used-air draw-in duct arranged vertically in the room and facing downwardly. A used-air pressure duct was connected to the draw-in duct and extended horizontally and outwardly through the wall of the building. A fresh-air duct was arranged above the used-air pressure duct and extended outwardly through the wall of the building. A connection duct connected the pressure duct with the fresh-air duct. A double flap was formed like a two-armed lever and was adapted to be pivoted between two end positions. In one end position the connection duct was closed by one-half of the flap and both the pressure duct the fresh-air duct was fully opened; in the other end position, the connection duct was opened, the fresh-air duct was closed by the flap half and the used-air pressure duct was closed by the other flap half. An axial-blow fan was adapted to be driven by a motor and was arranged in that part of the horizontal used-air pressure duct which was situated approximately within the range of the wall of the building.

Canadian Patent No. 942,572 patented Feb. 26th, 1974 by A.Ahlberg provided an arrangement at ventilation installations in apartment, office and similar rooms with high requirements on air comfort, including the supply of large fresh air quantities without causing appreciable draught and the removal of exhaust air from the room at an outer wall comprising a window. The patented improvement comprised at least two spaces in the wall formed by plane parallel plates. The first of the spaces was located farthest away from the room interior and formed an exhaust air passageway having one end in direct and free connection with the room adjacent the window, and the other end was adjacent the ceiling of the room connected with exhaust means extending through the remaining space of the arrangement. The second space was located closest to the room interior and was connected to a supply of fresh air adjacent to the ceiling of the room. Its lower part was in direct connection with the room interior. The second space had an air diffuser equipped with a damper means between he connections for the introduction of air to the room in a proportion of fresh air from the supply, and co-ejected room air from the connection with the room interior, the proportion being determined by the damper means.

Canadian Patent No. 1,057,562 patented Jul. 3, 1979 by I. C. Whiteley provided a device for circulating air between the floor and ceiling of a room to reduce temperature stratification and to decrease the energy required to maintain the room at a given temperature. The patented improvement was a floor-ceiling air circulating device comprising a base adapted to be supported on the floor of a room. A duct means extended vertically from the base to define a first flow path which extended from a lower inlet at the base and which terminated at an upper outlet adjacent to the ceiling of the room, and a second flow path which extended from a lower outlet at the base and which terminated at an upper inlet adjacent to the ceiling of the room. A fan was housed in the base for drawing air from the floor via the lower inlet and for forcing the air through the first flow path for discharge at the upper outlet adjacent to the ceiling and for drawing air from the ceiling via the upper inlet and the second flow path for discharge adjacent to the floor at the lower outlet. Air drawn from the ceiling was replaced by air drawn from the floor, and air drawn from the floor was replaced by air drawn from the ceiling.

Canadian Patent No. 1,090,190 patented Nov. 25, 1980 by D. B. Rusth provided a device for generating a circulatory flew of air within a room or closed area of a building structure. The patented improvement was an air circulator comprising a duct suspended from its upper end and which discharged an airflow towards the floor area of the room. A fan and motor assembly was provided. A support structure included a base to which the fan and motor assembly was attached. A hanger suspended the support structure from an overhead structure. The support structure additionally included mounts partially enclosed by the base and to which the upper end of the duct was attached, whereby the duct was in axial relationship with the fan of the fan and motor assembly. The base had a lowermost outer portion outwardly offset from the mounts and the upper end of the duct. The base received a fan-induced flow of heated convective air from the area of the room subjacent the roof or ceiling structure for subsequent downward flow into the duct upper end and passage via the duct to be discharged into an area superjacent the floor of the room to heat the latter area.

Canadian Patent No. 1,134,666 patented Nov. 2nd, 1982 by D. B. Rusth et al provided a device for use in enclosed areas for the purpose of circulating ambient air to avoid temperature stratification. The patented improvement was an air circulator comprising a support structure adapted for attachment to a superjacent support. A fan and motor assembly was supported by the support structure with the fan on a motor output shaft. Mounts were provided on the support structure past which a fan-discharged air moved. A perforate body carried by the mounts and having multiple passageways constrained passing of fan-discharged air for the formation of a linear stream of air. A constrictor subjacent to the perforate body served as a nozzle to constrict and accelerate the stream of air to enhance stream range and hence effectiveness.

U.S. Pat. No. 1,296,968 patented Mar. 11, 1919 by A. Klein provided a method and system for supplying air to interiors. The patented improvement provided a method of supplying air for effecting circulation of such air through the zone of occupancy. The method includes withdrawing air from the interior into a suitable conduit. A current of fresh air was combined therewith and the resulting mixture was discharged into the interior. The current of fresh air effected the withdrawal of the air from the interior and induced the circulation thereof through the conduit and into the interior. The air was withdrawn and introduced at different levels so that circulation thereof was effected through the zone of occupancy.

U.S. Pat. No. 1,925,822 patented Sep. 5, 1993 by W. Shurtleff provided a method and apparatus for heating and ventilating. The patented improvement provided a method of heating and ventilating rooms. The method included heating room air under thermostatic control responsive to thermal conditions at or below the breathing line. The discharge of downwardly-directed air current was thermostatically initiated when the temperature above the breathing line rose to a predetermined degree in excess of the controlled temperature at the breathing line. The speed of dissemination of the downwardly-directed currents under the last mentioned thermostatic control was ultimately increased when the temperature at the high level reached a predetermined maximum to break stratification of air in cold weather. It provided for the dissemination from above of cooling air currents in warm weather.

U.S. Pat. No. 2, 126,230 patented Aug. 9, 1938 by E. R. Troxell, Jr. provided distributing means for conditioned air, and a non-overloading distributing head having a high suction pressure and still maintaining free discharge of air all around the periphery of an open fan. The patented improvement provided a supply duct provided with a plurality of openings. A distributing head was provided adjacent to each opening, each head comprising an open centrifugal-type suction fan having substantially-free discharge of air all around its periphery. Air intakes communicated with the duct on one face only of the fan, the other face of the fan being sealed whereby only duct air can pass through the fan when the fan was operating. A motor was operatively connected to drive the fan. Each head included structure for providing an admixture of air from the space served with the discharge of duct air from the fan. Means were so constructed and arranged that change in the discharge of one of the distributing heads by reason of the stoppage of another of the heads and the leakage of space air back through the stopped head, was obviated.

U.S. Pat. No. 2,267,425 patented Dec. 23rd, 1941 by W. Rowe et al provided an air conditioning unit. The patented air conditioning device included a heat exchanger, a casing with inlet land outlet, and a fan to draw air from the inlet through the heat exchanger to the outlet. An air mixing and diffusing device was provided in co-operation with the outlet. Such device includes an outwardly-flaring annular member attached to the outlet of the casing and a second outwardly-flaring annular member spaced by a distance equal to one-third of the diameter of the fan from the first-mentioned member to form an air passage therebetween. The second member was hollow and was open at top and bottom. The top opening was substantially one-third of the diameter of the fan. Air was induced through the second member and out of the top opening, was mixed with the outlet air and was discharged through the passageway.

U.S. Pat. No. 2,275,295 patented Mar. 3rd, 1942 by G. H. Greenway provided an air conditioning unit. The patented air conditioning unit was adapted to be mounted adjacent the ceiling of a room. It included an elongate casing having an air inlet at its upper end. Such inlet extended substantially throughout the longitudinal width thereof. A curved grille covered the inlet. An air outlet extended substantially throughout the width of the casing at its lower end. Air-current impellers were disposed within the casing adjacent the inlet for circulating air downwardly through the casing. A cooling unit was mounted within the casing and had transverse coils and also upright fins mounted on the coils. The fins had their bottom edges inclined in a direction to cause droplets of water to gravitate out of the path of the air currents.

U.S. Pat. No. 2,354,292 patented Jul. 25, 1944 by A. E. Waterman provided a ventilating system for positive air control in buildings. The patented device was provided in combination with a room having a ceiling. An air duct was positioned above the ceiling and extended from the exterior of the building. The air duct had an inclosure to a downwardly-directed outlet positioned in the ceiling and substantially midway up the sides of the building. An electrically-operated cage-type fan was associated with the outlet, the fan having a vertically-arranged axis, with the cage of the fan being positioned to receive air from the outlet and to discharge it circumferentially and horizontally in contact with the ceiling. A roof ventilator was provided having an inlet which was adapted to receive air from the inclosure a distance from the fan. An opening was provided from the inclosure into the air duct and was positioned a distance from the fan and from the inlet of the roof ventilator. A valve was provided having a hinged support at the side of the opening toward the inlet end of the duct. A thermally-controlled device was associated with the valve and was positioned adjacent to the valve and within the inclosure. Such device had means to move the valve and more or less close the duct and the opening, thereby thermally to control the percentage of outside-to-inside air entering the fan when the fan was operating.

U.S. Pat. No. 2,398,627 patented Apr. 16, 1946 by I. R. Disbro et al provided a ceiling fan system. The patented improvement provided a room having a ceiling and a panel beneath the ceiling. The panel had an opening in the central part thereof for the passage of air therethrough. Outer edges of the panel were spaced from the side walls of the room for forming air passages therebetween. An air impeller was disposed intermediate the ceiling and panel and was in registry with the opening in the panel, for causing air to flow intermediate the ceiling and the panel. The panel had trough-like portions that substantially surrounded the central portion of the panel. Those portions were disposed intermediate the periphery of the air impeller and the outer edges of the panel. Germicidal lamps were disposed in the trough-like portions, the lamps being disposed below the upper surface of the panel.

U.S. Pat. No. 3,669,349 patented Jun. 13, 1972 by W. X. Hall, Jr. provided an air flow control system. The patented system included a powered mixing box adapted to be mounted adjacent to the supply opening for directing air through the supply opening into the room. The powered mixing box had a first inlet opening, a second inlet opening, and an outlet opening. A first structure formed a warm air supply path leading to the first inlet opening of the powered mixing box. A second structure formed a cool air supply path leading to the second inlet opening of the powered mixing box. A first pair of plates were provided, at least one of which was perforated. The first pair of plates was mounted so they were always immediately adjacent the first inlet opening and were transversely disposed in, and substantially normal to the warm air supply path. A second pair of plates was provided, at least one of which was perforated. The second pair of plates were mounted so they were always immediately adjacent the second inlet opening and were transversely disposed in, and substantially normal to the cool air supply path. Means interconnected one plate of each pair for moving one plate of the first pair relative to the other in a first sense, while moving one plate of the second pair relative to the other in a second sense to increase the proportion of air supplied to the powered mixing box through one air supply path while concurrently decreasing the proportion of air supplied to the powered mixing box through the other air supply path. The outlet opening was located in one wall of the powered mixing box and both of the inlet openings were displaced short distances from one wall of the powered mixing box to define a space which was wholly within the powered mixing box and which was bounded by the outlet opening and by the pairs of perforated plates. A fan was mounted in the space within the powered mixing box and was immediately adjacent to the pairs of plates. The fan was disposed within the space within the powered mixing box but was located downstream from the plates of the first pair of plates and also was located downstream from the plate of the second pair of plates. The fan received warm air from the warm air supply path via the first inlet opening and the first pair of plates, and received cool air from the cool air supply path via the second inlet opening and the second pair of plates. The fan mixed the warm air and the cool air and then moved the mixed air through the outlet opening and into the room through the supply opening.

U.S. Pat. No. 3,974,754 patented Aug. 17th, 1976 by J. W. Powlesland et al provided a controlled fluid flow system. The patented improvement provided an enclosure defining an interior space and separating the interior space from the exterior. A plenum was provided within the enclosure. A conduit communicated the plenum with the exterior, whereby gas from the exterior can be admitted to the plenum. The plenum was perforate to permit a relatively slow-speed flow of gas away from the perforate plenum, the plenum and conduit means being the only passageway by which gas from he exterior could enter the interior, apart from access doors and windows. A jet adjacent to the plenum was positioned so as to be within such slow-speed gas flow. The jet was adapted to propel a relatively high-speed jet of the gas toward an exhaust location within the enclosure, thereby to entrain additional gas from the slow-speed gas flow and to urge it toward the exhaust location. Exhaust means were provided at the exhaust location for exhausting substantially all of the gas arriving at the exhaust location to the exterior.

U.S. Pat. No. 4,535,684 patented Aug. 20, 1985 by G. Perng provided a ventilation system for an enclosed space. The patented system was especially suited for an enclosed occupied space which was defined by hollow walls and a ceiling. The system included a fresh air inlet and fresh air passage provided in the lower side of the walls, the fresh air passage having a plurality of fresh air outlet for supplying fresh air into the space. A plurality of exhaust air inlets was provided in the ceiling of the space. A first exhaust air discharge passage communicated with the exhaust air discharge passage communicated with the first discharge passage and was provided in the wall. A second exhaust air discharge passage communicated with the first discharge passage and also was provided in the wall. An exhaust air outlet was provided at the top of the second exhaust air passage. Means were provided for preventing backdraft at the exhaust air outlet, such means including a roof-shaped member having a first and a second flow regulating arrangement, each of which had a plurality of overlapping slats for opening and closing the air outlet. The first and second flow regulating arrangement was so arranged that when one of them was fully closed, the other was fully opened.

SUMMARY OF THE INVENTION (a) Aims of the Invention

The systems described in the above-defined patents are deficient since they do not solve the problem of avoiding the use of contaminated air, i.e., they all require mixing outdoor fresh air with recirculated air.

The principal object of the present invention is therefore to provide a room air circulating system which does not rely on the use of recirculated air.

Another object of this invention is to provide such a system which not only ventilates a room but which can also be used for heating or cooling a room.

(b) Statement of Invention, a system is provided for improving the condition and quality of indoor air in an inside room space comprising: (A) an inflow system comprising: (i) an outdoor air supply unit including an air supply inlet port provided in an air supply discharge duct and a fan connected between the air supply inlet port and the air supply discharge duct for discharging outdoor air through the air supply outlet duct; (ii) a variable air volume box having an air intake connected to the air supply discharge duct, an air outlet duct, an air outflow duct, and means to control the volume of air discharged through the air outflow duct; and (iii) a tube enclosure or cowl suspended from a ceiling of a room, the tube enclosure or cowl including a main air inlet port connected to the air outflow duct, a discharge outlet port, and a depending ceiling tan, the enclosure or cowl thereby feeding outdoor air to the vortex of the ceiling fan to discharge the outdoor air downwardly into the inside room space; and (B) an outflow system comprising: (a) an exhaust grill connected to the ceiling or to a wall of said inside room adjacent the ceiling; (b) an exhaust riser duct connected to the exhaust grill; and (c) an exterior exhaust fan connected to an outlet from the exhaust riser; the exterior exhaust fan (c) of the outflow system (B) being operated in conjunction with the fan of the outdoor air supply unit (i) of the air inflow system (A) to exhaust, via the outflow system (B), substantially all the volume of air inflowing through the air inflow system (A) into the inside room through the air outflow by system (B); thereby improving the quality of air in the inside room by: impelling a selected volume of the outdoor air downwardly into the inside room air, circulating the outdoor air within the inside room and expelling the selected volume of used room air from the room, and by allowing the occupant of the inside room to adjust comfort conditions by varying air circulation and the selected volume of outdoor air.

(c) Features of the Invention

By one feature of the invention, the air supply unit is situated outdoors on the roof of a building in which the room is situated.

By another feature of the invention all ducts are insulated. By a variation of such feature of the invention controls are provided to control the speed of the ceiling fan. By another variation of such feature, controls are provided for the variable air volume box to adjust the volume of outside air that can be introduced, thereby to vary the amount of ventilation. By yet another variation of such feature, the variable air volume box includes a heater therein, and controls are provided for controlling the heater.

By another feature of this invention the external air supply unit includes at least one of a filter, a heating coil, a cooling coil, a fan and a refrigeration compressor. By a variant of such feature, control means are provided to control the temperature of air which is admitted to the variable air volume box.

(d) Generalized Description of the Invention

The present invention thus consists of a ceiling fan unit within a tubular enclosure or cowling, which is suspended from the ceiling or the roof and which is open at the bottom. The fan unit is attached to the ceiling, in the usual manner for this type of fan. For purposes of ventilation and temperature control (e.g., heating), a flexible duct connects the tubular enclosure or fan cowl to a variable air volume (VAV) terminal box that is equipped with volume control dampers, and a suitable heater, e.g., a heating coil, which may be either electric or hydronic. Filtered air, that is cooled or heated as required by the outdoor temperatures during the different seasons and for different climates, is supplied to the VAV box by an external central air handling fan unit which may include one or more of a filter, a heating coil, a cooling coil, a fan, and a refrigeration compressor. Accordingly, as discussed above, the device of the present invention can be used for heating or cooling a room or space by combining it with a standard VAV terminal box. Controls are provided that permit the room occupant to vary the speed of the fan, and to vary the amount of ventilation, by adjusting the volume of outdoor air that can be introduced through the VAV. The room occupant can thus control the temperature in the room in either a heating mode or the cooling mode. At all times, the supply air to the ceiling fan is fresh air (which may be cooled), and the used room air is exhausted to the outside of the building.

In operation, the rotation of the ceiling fan in each room or space mixes the fresh entering air thoroughly with the room air. In this manner, the air circulation and mixing process alters the temperature of the room air so as either to heat or to cool the room or the space. This simultaneously ventilates the room or space by dilution of the pollution generated in the room or space. Such mixed air is expelled in the same volume as the fresh introduced air. The term for the process of diluting the pollution is called "Ventilation Effectiveness" or "contaminant removal effectiveness". It is measured by comparing the pollution concentration in the exhaust air from the room and the pollution concentration in the air at the breathing level. If they are the same, the ventilation effectiveness is one. If the concentration at the breathing level is higher, i.e., if the air is worse air, then the ventilation effectiveness is less than one, and more outdoor air must be introduced. If the pollution concentration at the breathing zone is less than the exhaust, i.e., better air, less air may be introduced.

The formula for determining Ventilation Effectiveness is:

$$e_v = \frac{c_e - c_s}{c_1 - c_s}$$

where $e_v$=ventilation effectiveness $c_s$=pollution concentration in the supply air $c_e$=pollution concentration in the exhaust air $c_1$=pollution concentration in the breathing zone.

The external air supply unit that supplies the fresh outdoor air may be similar to a conventional, commercially-available roof top unit, that has fans, filters, electric heating coil, refrigeration compressor with air condenser, and a cooling coil and which generally is provided with duct work connected to a VAV. The introduced fresh air then may be cooled and/or filtered to remove dust. A similar type unit can be housed in any other part of the building. Such a unit would supply the fresh outdoor air to each of the one or more VAV boxes that supply the fresh air to the one or more ceiling fans in one or more rooms.

In operation, the air leaving the external air supply unit is controlled to maintain a constant temperature which is lower than the room temperature. This temperature is suitable for cooling any space that needs cooling during the winter season (for example, in sun-exposed rooms with large glass areas). The VAV box has a heater to warm the air supply to maintain the temperature setting of the room thermostat. Thus, if a room needs heating, the room thermostat controls the heater coil in the VAV box to provide the required temperature. The air supply temperature to each room is adjustable by the room thermostat.

The air volume delivered to each fan is controlled by the dampers in the VAV box between two positions, i.e., minimum and maximum, but it remains constant at the minimum setting, unless the room occupant chooses to increase it.

As explained above, the ventilating air volume is constant at a minimum setting in the VAV box. The room occupant can vary the volume of ventilating air to the maximum if needed.

From the above it is clear that the room occupant can control the air temperature and the ventilation, without affecting the ventilation effect. The controls which are provided enable the required control and flexibility needed to adjust to changing environmental conditions. This provides maximum satisfaction and maximum energy conservation.

BRIEF DESCRIPTION OF THE DRAWINGS

In the accompanying drawings.

Figure 1:
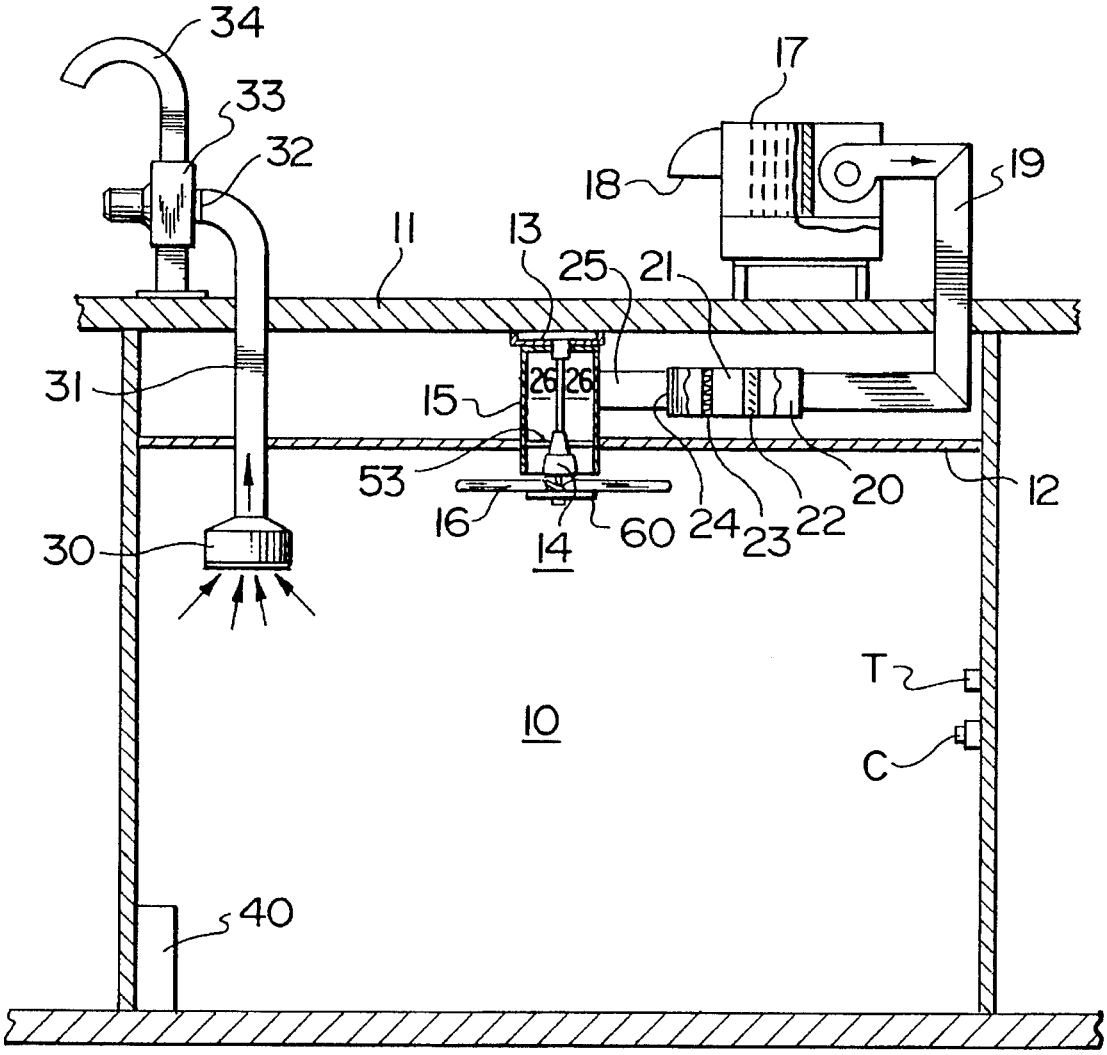
FIG. 1 is a schematic central longitudinal section through a room showing the components of the device of one embodiment of this invention.

DESCRIPTION OF PREFERRED EMBODIMENTS (a) Description of FIG. 1

As seen in FIG. 1, a room 10 is shown having an outdoor roof 11 and/or and a suspended ceiling 12. A set of ceiling fan support brackets 13 provide the means whereby a ceiling fan unit 14 with tube enclosure or cowl 15 may be suspended from the roof 11 and/or suspended ceiling 12 into the room 10. While not shown, other equivalent means may be provided to suspend the tube enclosure or cowl 15 from the roof 11 and/or the ceiling 12. Further details of the fan system will be given in the description of FIG. 2.

The ceiling fan unit 14 includes fan blades 16 and a deflector plate 60. Although not shown, the fan blades 15 may be provided with wire or other guards for safety reasons where needed.

Mounted on the roof 11 or even inside the building is a conventional is an air supply unit 17 provided with the usual filters, heating coil, cooling coil, fan and refrigeration compressor as required by regional climatic conditions. The air supply unit 17 includes an inlet 18 and an insulated air supply outlet duct 19.

Duct 19 leads to the inlet 20 of a variable air volume box 21, provided with dampers 22 and a heater 23, which may be electric or hydronic, with a high temperature limit control. The outlet 24 of the variable air volume box 21 leads, via a flexible insulated air duct 25, to the interior 26 of the cowl 15 of the fan system 14.

An exhaust grill 30 is provided within the room 10 near the suspended ceiling 12. The exhaust grill 30 includes an exhaust duct 31 leading to the inlet 32 of an exhaust fan 33. The exhaust fan 33 is provided with an conventional outlet duct 34.

The room 10 is provided with the usual room thermostat (T) and fan speed controls (C). In cold climates, a heater 40 may be provided to maintain a minimum temperature during freezing weather, or when the ventilation system is shut down, or when the building is not occupied. The heater 40 may be electric or hydronic.

Figure 2:
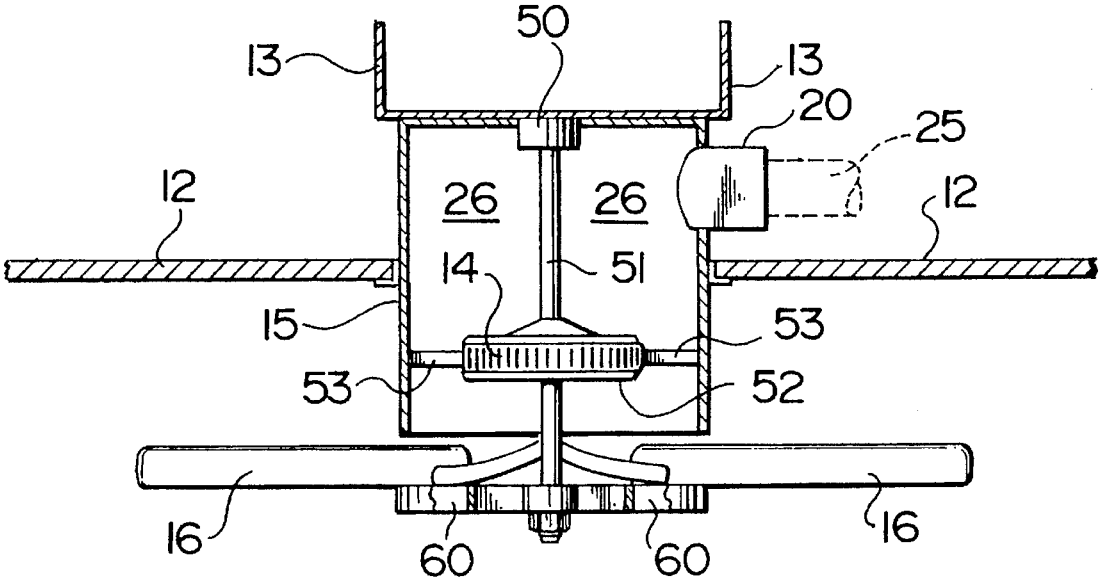
FIG. 2 is a central longitudinal section through the ceiling fan portion of the device of one embodiment of the invention.
Figure 3:
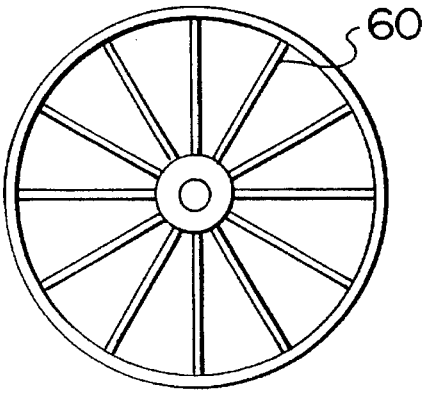
FIG. 3 is a bottom plan view of the view depicted in FIG. 2, showing the deflection plate.

(b) Description of FIGS. 2 and 3

As seen in FIG. 2, an electric junction box 50 is fixed to the attachment bracket 13. Also suspended from the attachment bracket 13 is a cowl or tube 15 which is open at the bottom and which extends through the suspended ceiling 12. An outdoor air supply collar 20 is fitted to the cowl 15.

Suspended from the electric junction box 50 is a pipe 51 containing the electrical wires, the pipe 51 being connected to the fan motor 52. The fan motor 52 is secured by a spider brace 53 to the interior of the cowl 15. The fan blades 16 are driven by the fan motor 52. The fan blades 15 are provided with a deflector plate 60 (better seen in FIG. 3).

ADVANTAGES OF THE PRESENT INVENTION

It is known that the rate of air supply required either to heat or to cool a room that has a heat loss or heat gain varies inversely as the temperature difference between the air supply temperature and the room temperature. To avoid uncomfortable air currents from grills or diffusors, present design criteria limit the temperature difference between the supply air and the room air to about 3° to about 4° F. This temperature difference is critical with ceiling heights of 8 feet or less, since in rooms with dropped (lowered) ceilings, there is more chance of occupant discomfort.

With the device of the present invention which mixes the fresh air with the existing room air throughout as the fresh air is introduced, the temperature difference can be as high as about 10° to about 15° F. with ceiling heights 8 feet or less. Furthermore, the room occupant can control the fan speed to vary the air movement and mixing. Therefore, the air volume to heat or to cool is less with the device of the present invention in the ratio of about ⅓ to about ⅕ of that required for grills or diffusors. This reduces costs and operating expenses accordingly.

As noted above, in rooms with dropped (lowered) ceilings of 8 feet height, there is more change of occupant discomfort. Accordingly, the device of the present invention is effective in landscaped offices, (with low partitions) private offices, and offices with low partitions, since it includes the combination with a VAV box, and an external air supply unit, that has both a heating and a cooling capability. The system of the present invention enables the room occupant to control the ventilation rate, and the Ventilation Effectiveness (by adjusting the air volume and/or the fan speed). This is not possible with any other type of forced air circulation system that uses grills or diffusers. Another unique feature of the present invention is that the used, or exhaust, air is constantly ejected from the building.

In the device of the present invention, the ceiling fan produces mixing instead of unpredictable discharge jets or currents from grills or diffusers. The ceiling fan mixing is positive and produces a Ventilation Effectiveness of one. As noted hereinbefore, the fan speed can be varied to suit the variations in ventilation requirements in the room. Therefore using the device of the present invention reduces the cost of the air handling system, since ducts, fans, motors, and all other related equipment cost less. Thus, another advantage of using the device of the present invention is cost reduction of the installation. The energy requirements are less because the ceiling fan requires much less energy, compared to the energy required continually to move air through grills and diffusers.

The device of the present invention maximizes the performance of forced air circulation systems when they are used for ventilating, cooling and heating spaces for human occupancy.

The device of the present invention introduces outdoor air directly to the occupied rooms and mixes it thoroughly with the room air, namely it provides direct air injection. The room occupant can control the fan speed. The mixing process is proportional to the fan speed.

Used air is exhausted from the building. This eliminates the systemic contamination of supply ducts when return air is mixed with outdoor air and the mixture supplied to the rooms. This also reduces maintenance by eliminating the need to clean ducts. There are reduced maintenance expenses since only the external filter must be cleaned.

In buildings where smoking is not permitted, the device of the present invention can be used for ventilating areas that are isolated for smokers.

The device of the present invention can be used to modify existing systems, by adding exhaust ducts where necessary without changing the supply ducts.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A system for improving the condition and quality of indoor air in an inside room space of a room comprising:

(A) an inflow system comprising:

(i) an outdoor air supply unit including an air supply discharge duct, an air supply inlet port communicating with said air supply discharge duct and a fan connected between said air supply inlet port and said air supply discharge duct for supplying outdoor air through said air supply inlet port into said air supply discharging duct;

(ii) a variable air volume box having both an air intake connected to said air supply discharge duct and an air outflow duct, and means to control the volume of air discharged through said air outflow duct;

(iii) a tube enclosure or cowl suspended from a ceiling of said room, said tube enclosure or cowl including a main air inlet port having an inlet which is connected to said air outflow duct, a discharge outlet port, and a depending ceiling fan positioned below said discharge outlet port whereby said tube enclosure or cowl feeds outdoor air to said ceiling fan to discharge said outdoor air downward into said inside room space; and (B) an outflow system comprising:

(a) an exhaust grill connected to the ceiling or to a wall of said inside room adjacent the ceiling;

(b) an exhaust riser duct connected to said exhaust grill; and (c) an exterior exhaust fan connected to an outlet from said exhaust riser;

said exterior exhaust fan being operated in conjunction with said fan which is connected between said air supply inlet port and said air supply discharge duct to exhaust, via said outflow system, substantially all the volume of air inflowing through said air inflow system into said inside room space;

thereby improving the quality of air in said inside room space by: impelling a selected volume of said outdoor air downwardly the air of inside room space air, circulating said outdoor air within said inside room space and expelling said selected volume of used room air from said inside room, and by allowing the occupant of said room space to adjust comfort conditions by varying air circulation and the selected volume of outdoor air.

2. The system of claim 1 wherein said fan which is connected between said air supply inlet port and said air supply discharge duct is driven by a variable speed motor and including controls to control the speed of said fan.

3. The system of claim 1 wherein said ceiling fan blades project into said room adjacent said ceiling.

4. The system of claim 3 including a deflection plate associated with said blades of said ceiling fan.

5. The system of claim 1 wherein said variable air volume box includes dampers therein, and including control means for adjusting said dampers.

6. The system of claim 1 wherein said variable air volume box include a heater and control means for controlling said heater.

7. The system of claim 1 wherein said outdoor air supply unit includes at least one of a filter, a heating coil, a cooling coil, a fan, and a refrigeration compressor.

8. The system of claim 6 wherein said outdoor air supply unit includes at least one of a filter, a heating coil, a cooling coil, a fan, and a refrigeration compressor.

9. The system of claim 8 including control means to control the temperature of air which is admitted to said variable air volume box.

* * * * *